United States Patent [19]

Meile et al.

[11] Patent Number: 4,539,729

[45] Date of Patent: Sep. 10, 1985

[54] APPARATUS FOR THE CONTINUOUS COMPRESSION OR DETERMINATION OF THE MASS OF A FIBER SLIVER

[75] Inventors: Hanspeter Meile, Winterthur; Viktor Pietrini, Wiezikon, both of Switzerland

[73] Assignee: Rieter Machine Works Ltd., Winterthur, Switzerland

[21] Appl. No.: 432,767

[22] Filed: Oct. 4, 1982

[30] Foreign Application Priority Data

Oct. 29, 1981 [CH] Switzerland ..... 6912/81

[51] Int. Cl.[3] ..... D01H 5/72

[52] U.S. Cl. ..... 19/288; 19/286; 19/258

[58] Field of Search ..... 19/288, 286, 290, 258

[56] References Cited

U.S. PATENT DOCUMENTS

| | | | |
|---|---|---|---|
| 730,711 | 6/1903 | Slater | 19/288 |
| 1,433,529 | 10/1922 | Butler | 19/286 |
| 1,936,443 | 11/1933 | Abbott | 19/288 X |
| 2,238,659 | 4/1941 | Reynolds | 19/288 X |
| 2,244,461 | 6/1941 | Kettley | 19/258 |
| 4,413,378 | 11/1983 | Mandl et al. | 19/258 |

FOREIGN PATENT DOCUMENTS

| | | | |
|---|---|---|---|
| 310958 | 4/1929 | United Kingdom | 19/286 |
| 128343 | 8/1960 | U.S.S.R. | 19/288 |

*Primary Examiner*—Werner H. Schroeder
*Assistant Examiner*—J. L. Kravitz
*Attorney, Agent, or Firm*—Werner W. Kleeman

[57] ABSTRACT

Fiber slivers must be condensed during the course of a spinning process or their mass must be determined. For this purpose there are employed so-called grooved pairs of rollers, that is to say, profiled rolls which define a sliver throughput groove which is limited or confined at both sides. The sliver is guided through a feed or delivery funnel up to the throughput groove. The danger thus exists that individual fibers can jam between the side surfaces or faces of the rollers which form the lateral boundaries of the groove. This danger is eliminated with the invention in that the fiber outlet opening of the feed funnel is located within the region of a wedge-shaped gap which is bounded by an overlapping zone of the side surfaces or faces of the rollers.

7 Claims, 4 Drawing Figures

APPARATUS FOR THE CONTINUOUS COMPRESSION OR DETERMINATION OF THE MASS OF A FIBER SLIVER

BACKGROUND OF THE INVENTION

The present invention relates to a new and improved construction of apparatus for the continuous compression or determination of the mass of a fiber sliver.

Generally speaking, the apparatus of the present development is of the type comprising a pair of rollers or rolls which can be pressed towards or against one another, and the peripheral portions of these rollers interengage or mutually coact with one another in such a manner that there is formed a laterally defined or limited nip zone. A sliver feed or delivery funnel which infeeds the sliver coacts with the cooperating pair of rollers.

Condensing and measuring apparatuses for slivers formed of textile fibers associated with a card or with a drafting frame have been known and used for quite some time.

In German Patent Publication No. 2,802,735 there is disclosed a condensing apparatus of this type, wherein the inner part of a funnel protrudes into the wedge-shaped gap of two disk-like rollers which can be pressed towards one another. The frusto-conical outer part of the funnel laterally covers the end faces of the rollers at the nip region, and thus, closes off the wedge-shaped gap towards the outside. With this prior art apparatus the sliver is fed close to the nip region or zone of the rollers or rolls, however it is not possible to avoid jamming of the fibers at the sides between the rotating end faces of the rollers and the stationary outer part of the funnel which closes off at the sides the wedge-shaped gap and the nip region of the rollers.

SUMMARY OF THE INVENTION

Therefore it is a primary object of the present invention to provide a new and improved construction of apparatus for the continuous compression or determination of the mass of a fiber sliver in a manner not associated with the aforementioned drawbacks and limitations of the prior art proposals.

Another and more specific object of the present invention aims at preventing the lateral escape of fibers out of the nip region or zone of the rolls or rollers and the thus resulting jamming of the apparatus and formation of troublesome fiber accumulations or agglomerations.

Still a further significant object of the present invention is directed to a new and improved construction of apparatus for the continuous compressing or determination of the mass of a fiber sliver, which apparatus is relatively simple in construction and design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus of the present development is manifested by the features that the fiber outlet or exit opening of the funnel is located within the region of a wedge-shaped gap which is bounded by an overlapping zone of the side or lateral surfaces or faces of the rollers.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
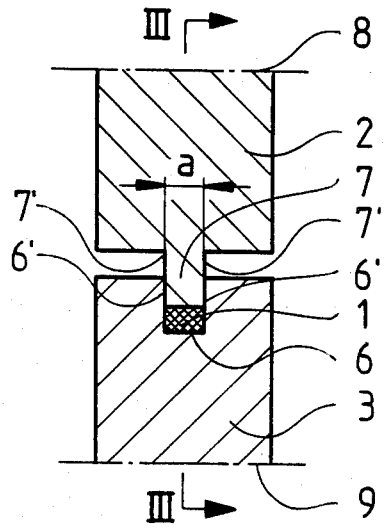
FIG. 1 is a fragmentary cross-sectional view through the nip region or zone of a first roller arrangement of an apparatus for the continuous compression or determination of the mass of a fiber sliver and constructed according to the present invention.
Figure 2:
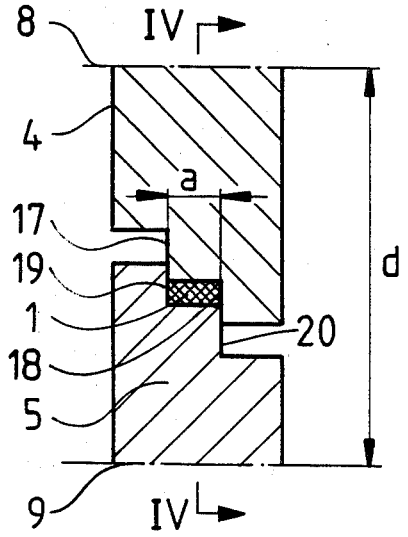
FIG. 2 is a fragmentary cross-sectional view, similar to the showing of FIG. 1, through the nip region or zone of a different roller arrangement according to the invention.

Describing now the drawings, it is to be understood that only enough of the construction of the exemplary embodiments of apparatus for the continuous compression or determination of the mass of a fiber sliver or the like have been shown as needed for those skilled in the art to readily understand the underlying principles and concepts of the present development, while simplifying the illustration of the drawings. Turning attention now to the two different constructions of inventive apparatus containing roller arrangements depicted in FIGS. 1 and 2, there are specifically shown therein respective cross-sectional views through the nip or compressing lines or zones 1 of two different embodiments of roller pairs 2,3 and 4,5, respectively. With the construction of FIGS. 1 and 3, the roll or roller 3 will be seen to be provided with a peripheral groove or channel 6 into which engages a peripherally or circumferentially extending flange 7 of the other coacting roll 2 with a slight play between the side or lateral faces or surfaces 7' of the protruding flange 7 and the side or lateral faces or surfaces 6' of the groove 6. A somewhat different embodiment is depicted in FIGS. 2 and 4. Here, the peripheral portions or peripheries of the coacting rolls or rollers 4 and 5 are configured in a stepped-shape fashion so as to form oppositely matched step-like portions, arranged in mirror-image fashion, and likewise forming at the central region a compressing or nip line 1. Also in this case the side or lateral faces 17 and 18 of the roller 4 are located with a slight play with respect to the respective coacting side or lateral faces 19 and 20 of the cooperating roll or roller 5. The axes of rotation 8 and 9 of the rollers 2,3 and 4,5, respectively, are pressed towards one another in conventional fashion and their mutual axial spacing d can be beneficially employed as a measuring magnitude or quantity.

Figure 3:
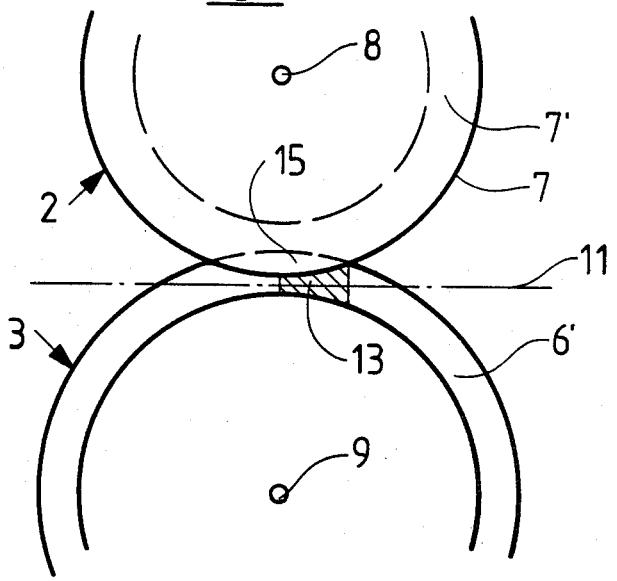
FIG. 3 is a cross-sectional view of the arrangement of FIG. 1, taken substantially along the line III—III thereof.
Figure 4:
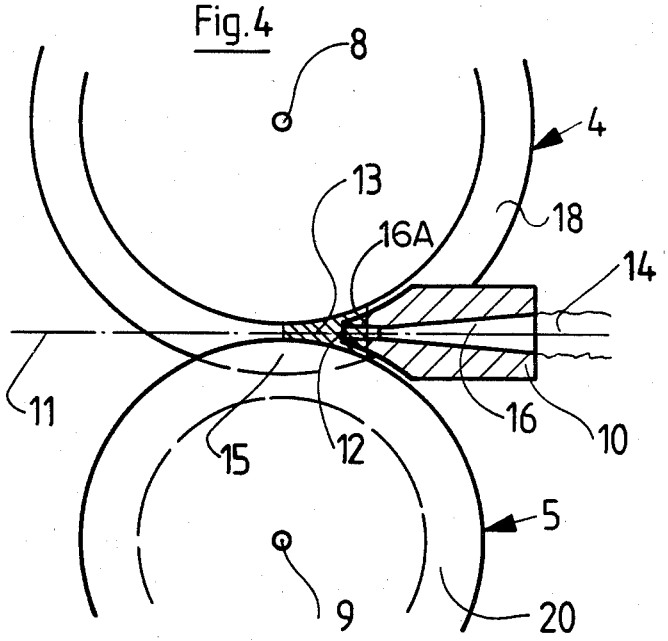
FIG. 4 is a cross-sectional view of the arrangement of FIG. 2, taken substantially along the line IV—IV thereof.

With reference now to FIG. 3 there will be discussed the position of the sliver feed funnel 10, as contemplated by the invention, relative to the coacting pair of rollers 2 and 3. As to a possible construction of the sliver feed funnel 10 attention is directed to FIG. 4 showing details thereof. Conceptually, it is to be therefore assumed that a similar type of sliver feed funnel 10 is arranged at the region of the wedge-shaped gap 13, in a manner to be more fully discussed hereinafter, with respect to the arrangement of FIG. 3. The lengthwise extending or central axis 11 of the feed funnel 10 extends essentially at right angles to a connection plane containing both of the roller axes 8 and 9 and passing through the nip line or nip 1. More specifically, the outlet or exit opening 12 of the feed funnel 10 extends exactly so far into the wedge-shaped gap 13 forwardly of the nip line 1 that a sliver 14 or the like emerging from this outlet or exit opening 12 cannot widen-out forwardly of the nip line 1 beyond the lateral dimension a of such nip line, which lateral dimension a constitutes the width or breadth of the nip line or zone 1. The lateral confinement of the fiber sliver 14 is ensured for by virtue of this arrangement within an overlapping zone 15 of the side surfaces or faces 6' of the groove or channel 6 and the side surfaces or faces 7' of the protruding flange 7, and there is beneficially precluded any undesirable jamming of individual fibers of the conglomeration of fibers contained in the fiber sliver 14. FIG. 4 analogously shows these conditions when employing the previously explained step-like configuration of the rollers 4 and 5, where the coacting side surfaces or faces 17, 18 and 19, 20 are located opposite one another with a small amount of play.

The stationary sliver feed funnel 10 therefore does not form at any location part of the lateral boundary of the wedge-shaped gap 13. Consequently, there is precluded right from the start that fibers which possibly laterally escape out of the nip line 1 can become caught between a moving part and a stationary part of the apparatus.

Preferably, the maximum diameter of the outlet or exit opening 12 of the sliver feed funnel 10 is maintained somewhat smaller than the lateral dimension or expanse a of the nip line 1 or the wedge-shaped gap 13. In order to be able to lead the fiber sliver 14 with the largest possible cross-sectional area as closely as possible up to the nip line 1, the part 16*a* of the funnel bore 16 extending within the overlapping zone 15 of the side surfaces or faces 6', 7' or 17, 18 and 19, 20, respectively, is designed to possess an essentially cylindrical configuration.

The described constructions and measures incipiently prevent the widening or spreading-apart of the fiber sliver 14 before and during the compression or compaction process. At the same time, however, there is obviated the danger of emergence of fibers into the end-face regions 6', 7' or 17, 18 and 19, 20 of the pairs of rollers or rolls 2,3 or 4,5, respectively.

While there are shown and described preferred embodiments of the invention, it is to be distinctly understood that the invention is not limited thereto, but may be otherwise variously embodied and practiced within the scope of the following claims.

Accordingly, what we claim is:

1. An apparatus for the continuous compression or determination of the mass of a fiber sliver, comprising:

a pair of coacting rollers which can be pressed towards one another;

each of said rollers having a peripheral portion;

said rollers possessing side surfaces cooperating with one another at an overlapping zone;

said peripheral portions of said rollers interengaging with one another in such a manner that there is formed a laterally bounded nip zone at the region of said cooperating side surfaces;

a feed funnel for inputting fiber sliver to the nip zone of said coacting rollers;

said feed funnel having a fiber outlet opening; and said fiber outlet opening of said feed funnel being disposed within the region of a substantially wedge-shaped gap which is bounded by said overlapping zone of said side surfaces of the coacting rollers.

2. The apparatus as defined in claim 1, wherein:

the fiber outlet opening of said feed funnel has a diameter which is smaller than the length of a nip line of said nip zone.

3. The apparatus as defined in claim 2, wherein:

said feed funnel has a bore through which passes the fiber sliver; and said bore possessing a substantially cylindrical portion located within the overlapping zone.

4. The apparatus as defined in claim 1, wherein:

the fiber outlet opening of said feed funnel has a diameter which is smaller than the width of the wedge-shaped gap.

5. The apparatus as defined in claim 4, wherein:

said feed funnel has a bore through which passes the fiber sliver; and said bore possessing a substantially cylindrical portion located within the overlapping zone.

6. The apparatus as defined in claim 1, wherein:

the fiber sliver does not undergo any further guidance from parts of the feed funnel after emergence of said fiber sliver from the outlet opening of said feed funnel.

7. The apparatus as defined in claim 1, wherein:

each said roller defines an axis:

said pair of coacting rollers defines a plane containing said axes of said rollers;

said feed funnel defines a lengthwise axis; and said lengthwise axis of said feed funnel extending essentially normally relative to said plane containing said axes of said rollers.

* * * * *